US006218992B1

(12) United States Patent
Sadler et al.

(10) Patent No.: US 6,218,992 B1
(45) Date of Patent: Apr. 17, 2001

(54) COMPACT, BROADBAND INVERTED-F ANTENNAS WITH CONDUCTIVE ELEMENTS AND WIRELESS COMMUNICATORS INCORPORATING SAME

(75) Inventors: Robert A. Sadler, Raleigh; Gerard James Hayes, Wake Forest; Mohammod Ali, Cary, all of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/512,493

(22) Filed: Feb. 24, 2000

(51) Int. Cl.[7] ..... H01Q 1/24
(52) U.S. Cl. ..... 343/702; 343/825; 343/848
(58) Field of Search ..... 343/702, 846, 343/700 MS, 848, 825; H01Q 1/36

(56) References Cited

U.S. PATENT DOCUMENTS 5,007,105 * 4/1991 Kudoh et al. ..... 455/344
5,420,599 * 5/1995 Erkocevic ..... 343/702
5,668,560 * 9/1997 Evans et al. ..... 343/702
5,926,139 * 7/1999 Korisch ..... 343/702
5,966,097 * 10/1999 Fukasawa et al. ..... 343/702
6,005,524 * 12/1999 Hayes et al. ..... 343/702
6,130,650 * 10/2000 Curtis et al. ..... 343/846

* cited by examiner

*Primary Examiner*—Hoanganh Le
*Assistant Examiner*—Hoang Nguyen
(74) *Attorney, Agent, or Firm*—Myers Bigel Sibley & Sajovec

(57) ABSTRACT

Inverted-F antennas having elongated, conductive elements for use within communications devices, such as radiotelephones, are provided. An elongated, meandering conductive element having a plurality of spaced-apart U-shaped undulations is maintained in adjacent, spaced-apart relationship with a first ground plane. One or more of the U-shaped undulations capacitively couple to the ground plane and allow the antenna to resonate at lower frequencies and with a greater bandwidth. A second ground plane may be oriented in a direction transverse to the first ground plane so as to be positioned in adjacent, spaced-apart relationship with one or more of the U-shaped undulations. One or more of the U-shaped undulations can capacitively couple to the second ground plane, as well as to the first ground plane. In addition, one or more inductive elements may be electrically connected to an elongated conductive element.

41 Claims, 5 Drawing Sheets

COMPACT, BROADBAND INVERTED-F ANTENNAS WITH CONDUCTIVE ELEMENTS AND WIRELESS COMMUNICATORS INCORPORATING SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

In addition, it is becoming desirable for radiotelephones to be able to operate within multiple frequency bands in order to utilize more than one communications system. For example, GSM (Global System for Mobile) is a digital mobile telephone system that operates from 880 MHz to 960 MHz. DCS (Digital Communications System) is a digital mobile telephone system that operates from 1710 MHz to 1880 MHz. The frequency bands allocated for cellular AMPS (Advanced Mobile Phone Service) and D-AMPS (Digital Advanced Mobile Phone Service) in North America are 824–894 MHz and 1850–1990 MHz, respectively. Since there are two different frequency bands for these systems, radiotelephone service subscribers who travel over service areas employing different frequency bands may need two separate antennas unless a dual-frequency antenna is used.

Inverted-F antennas are designed to fit within the confines of radiotelephones, particularly radiotelephones undergoing miniaturization. As is well known to those having skill in the art, inverted-F antennas typically include a linear (i.e., straight) conductive element that is maintained in spaced apart relationship with a ground plane. Examples of inverted-F antennas are described in U.S. Pat. Nos. 5,684,492 and 5,434,579 which are incorporated herein by reference in their entirety.

Conventional inverted-F antennas, by design, resonate within a narrow frequency band, as compared with other types of antennas, such as helices, monopoles and dipoles. In addition, conventional inverted-F antennas are typically large. Lumped elements can be used to match a smaller non-resonant antenna to an RF circuit. Unfortunately, such an antenna would be narrow band and the lumped elements would introduce additional losses in the overall transmitted/received signal, would take up circuit board space, and add to manufacturing costs.

High dielectric substrates are commonly used to decrease the physical size of an antenna. Unfortunately, the incorporation of higher dielectrics can reduce antenna bandwidth and may introduce additional signal losses. As such, a need exists for small, internal radiotelephone antennas that can operate within multiple frequency bands, including low frequency bands.

SUMMARY OF THE INVENTION

In view of the above discussion, the present invention can provide various configurations of compact, broadband inverted-F antennas for use within communications devices, such as radiotelephones. According to one embodiment, an inverted-F antenna has an elongated, meandering conductive element maintained in adjacent, spaced-apart relationship with a first ground plane, such as a printed circuit board. An elongated, meandering conductive element according to this embodiment, includes a set of spaced-apart, U-shaped undulations that extend towards the first ground plane. The U-shaped undulations capacitively couple to the first ground plane and allow the antenna to resonate at lower frequencies than a conventional inverted-F antenna.

According to another embodiment of the present invention, a second ground plane may be oriented in a direction transverse to the first ground plane so as to be positioned in adjacent, spaced-apart relationship with one or more of the U-shaped undulations. The one or more U-shaped undulations are capacitively coupled to the second ground plane, as well as to the first ground plane.

According to another embodiment of the present invention, one or more raised portions extend outwardly from a ground plane and capacitively couple to portions of an elongated conductive antenna element.

According to another embodiment of the present invention, one or more inductive elements may be electrically connected to an elongated conductive element. An inductive element may comprise helical turns formed in an elongated conductive element or one or more electronic components that serve an inductive function.

Antennas according to the present invention may be particularly well suited for use within a variety of communications systems utilizing different frequency bands. Furthermore, because of their small size, antennas according to the present invention may be easily incorporated within small communications devices. In addition, antenna structures according to the present invention may not require additional impedance matching networks, which may save internal radiotelephone space and which may lead to manufacturing cost savings.

DETAILED DESCRIPTION OF THE INVENTION

Figure 1:
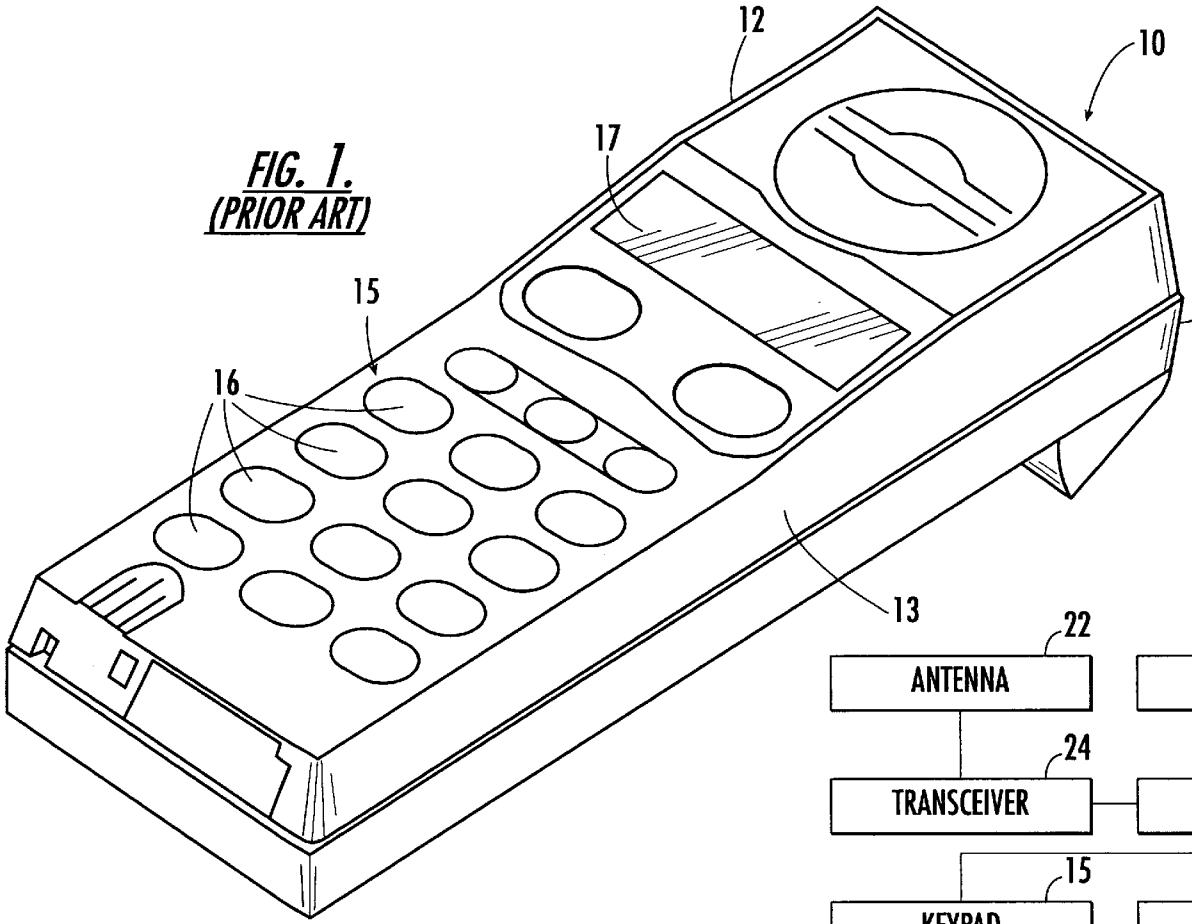
FIG. 1. (PRIOR ART)
FIG. 1 is a perspective view of an exemplary radiotelephone within which an antenna according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another element, there are no intervening elements present. Moreover, each embodiment described and illustrated herein includes its complementary conductivity type embodiment as well.

Referring now to FIG. 1, a radiotelephone 10, within which antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

Figure 2:
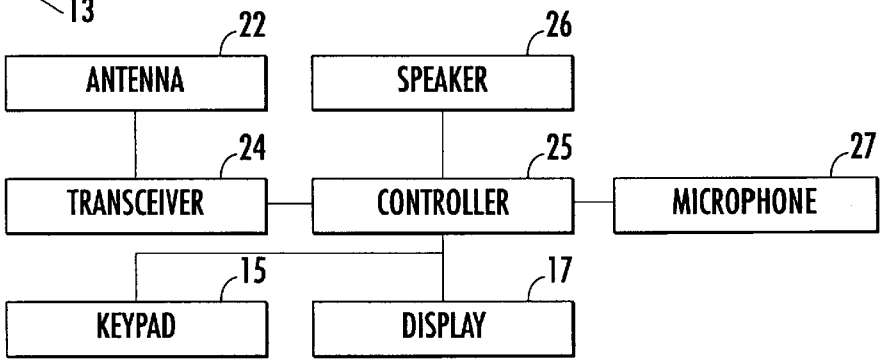
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 3A:
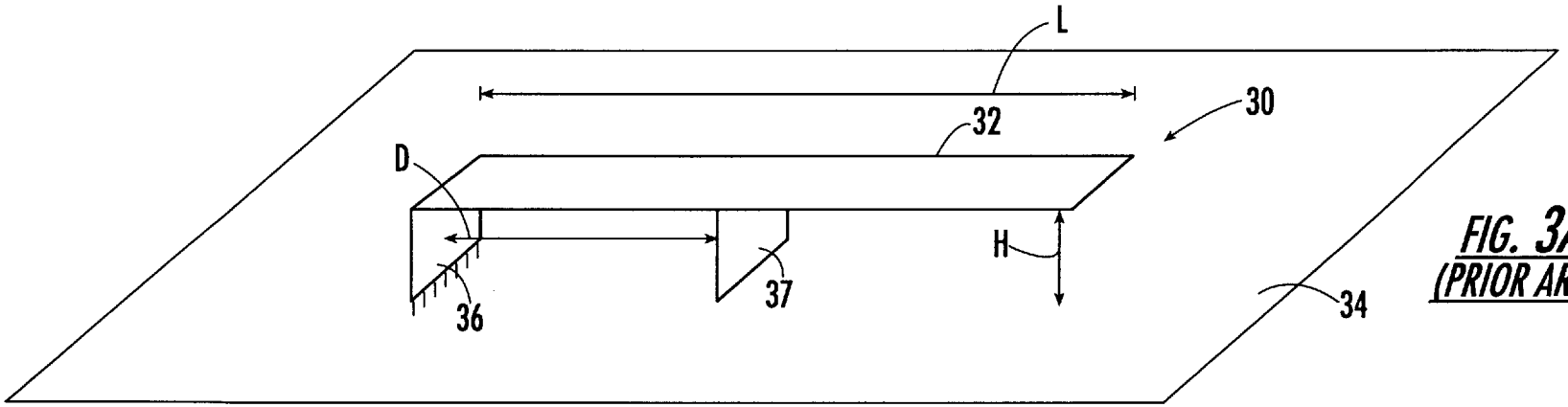
FIG. 3A. (PRIOR ART)
FIG. 3A is a perspective view of a conventional planar inverted-F antenna.
Figure 3B:
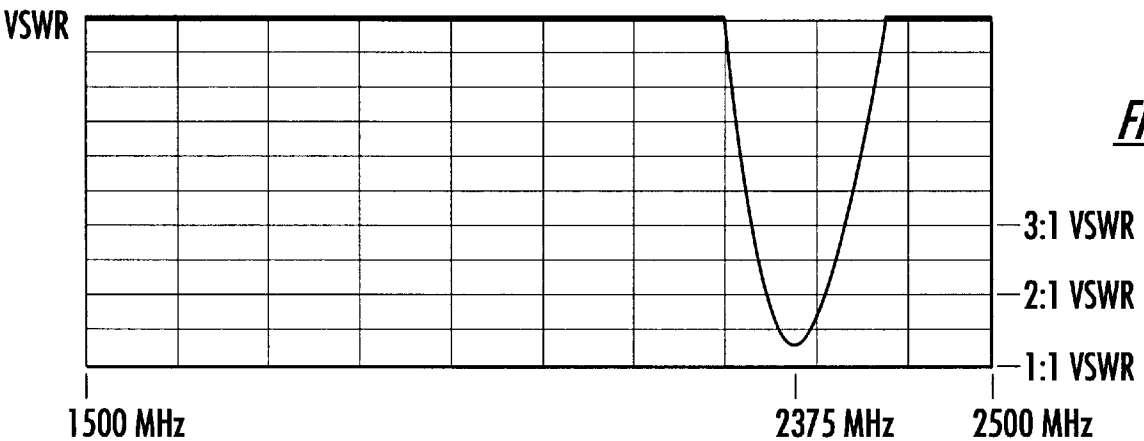
FIG. 3B is a graph of the VSWR performance of the antenna of FIG. 3A.

Referring now to FIG. 3A, a conventional inverted-F antenna is illustrated. The illustrated antenna 30 includes a linear conductive element 32 maintained in spaced apart relationship with a ground plane 34. Conventional inverted-F antennas, such as that illustrated in FIG. 3A, derive their name from a resemblance to the letter "F." The conductive element 32 is grounded to the ground plane 34 as indicated by 36. A hot RF connection 37 extends from underlying RF circuitry through the ground plane 34 to the conductive element 32. FIG. 3B is a graph of the VSWR performance of the inverted-F antenna 30 of FIG. 3A. As can be seen, the antenna 30 was designed to radiate at about 2375 Megahertz (MHz).

Figure 4A:
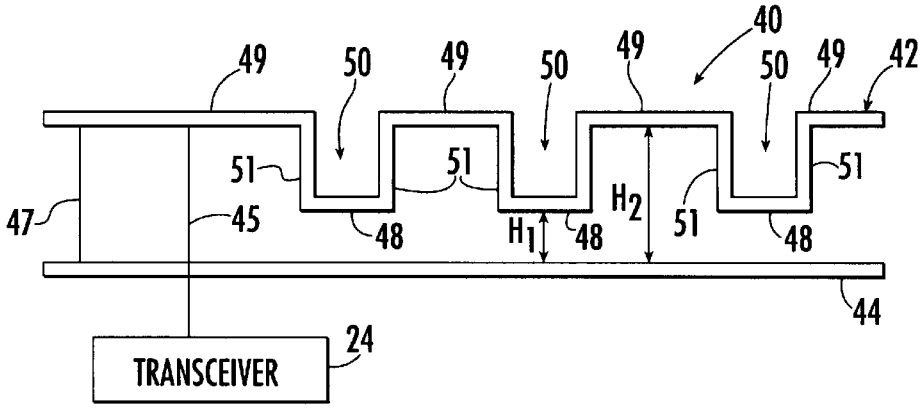
FIG. 4A is a side elevation view of an inverted-F antenna having an elongated, meandering conductive element with a plurality of U-shaped undulations in spaced-apart, adjacent relationship with a ground plane according to an embodiment of the present invention.

Referring now to FIG. 4A, an inverted-F antenna 40 having an elongated, meandering conductive element 42, according to an embodiment of the present invention, is illustrated in an installed position within a wireless communications device, such as a radiotelephone. The elongated, meandering conductive element 42 is maintained in adjacent, spaced-apart relationship with a ground plane 44 (e.g., a printed circuit board). A signal feed 45 electrically connects the conductive element 42 to an RF transceiver 24 within a wireless communications device. A ground feed 47 grounds the conductive element 42 to the ground plane 44.

In the illustrated embodiment, the elongated, meandering conductive element 42 includes a first plurality of segments 48 that are spaced apart from the first ground plane by a first distance $H_1$. A second plurality of segments 49 are spaced apart from the first ground plane by a second distance $H_2$ which is greater than the first distance $H_1$. The distance $H_1$, between the conductive element segments 48 and the ground plane 44 is preferably maintained at between about 1 mm and about 5 mm. The distance $H_2$ between the conductive element segments 49 and the ground plane 44 is preferably maintained at between about 5 mm and about 15 mm.

In the illustrated embodiment, the elongated, meandering conductive element 42 includes a plurality of spaced-apart undulations 50. Each undulation 50 has a U-shaped configuration that extends towards the ground plane 44. Each U-shaped undulation 50 in the illustrated embodiment includes a pair of spaced-apart side segments 51 that extend towards the ground plane 44. Each U-shaped undulation 50 also includes a base segment 48 that connects a respective pair of spaced-apart side segments 51 together. Each base segment 48 is capacitively coupled with the ground plane 44.

In the illustrated embodiment, the base segment of each U-shaped undulation 50 is substantially orthogonal to the respective pair of spaced-apart side segments 51 (and substantially parallel with the ground plane 44). It is understood, however, that an elongated, meandering conductive element according to the present invention can have undulations with various shapes and configurations and is not limited to the illustrated U-shaped undulations 50.

Figure 4B:
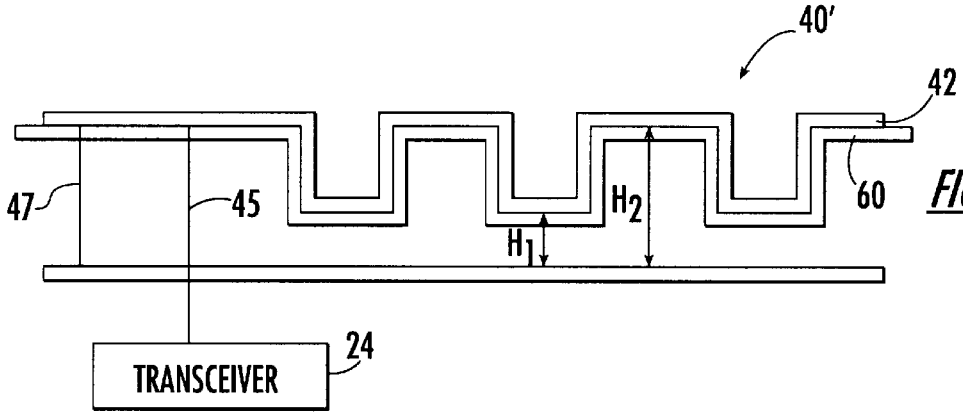
FIG. 4B is a side elevation view of the inverted-F antenna of FIG. 4A disposed on a dielectric material.
Figure 4C:
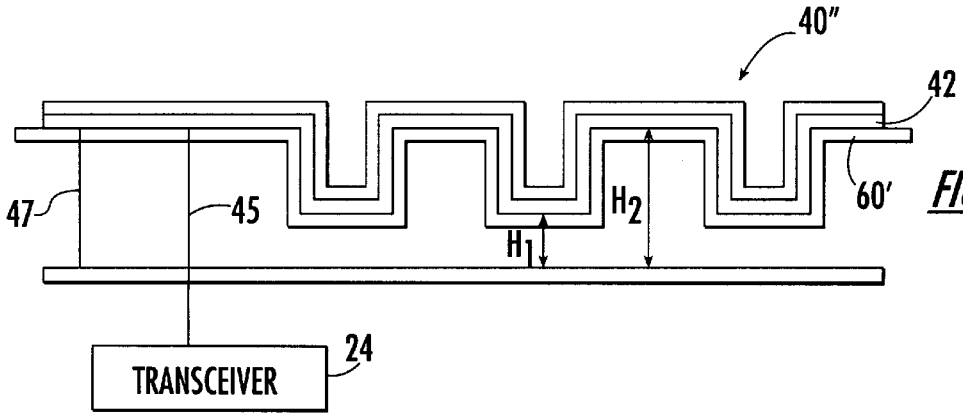
FIG. 4C is a side elevation view of the inverted-F antenna of FIG. 4A disposed within a dielectric material.

Referring now to FIGS. 4B and 4C, alternative embodiments of the present invention are illustrated. In FIG. 4B, an inverted-F antenna 40' has an elongated, meandering conductive element 42 disposed (i.e., formed) on dielectric material 60. The elongated, meandering conductive element 42 may be formed by etching a conductive layer formed on the dielectric material 60. In FIG. 4C, an inverted-F antenna 40" has an elongated, meandering conductive element 42 disposed within dielectric material 60' (e.g., a dielectric substrate).

Figure 5:
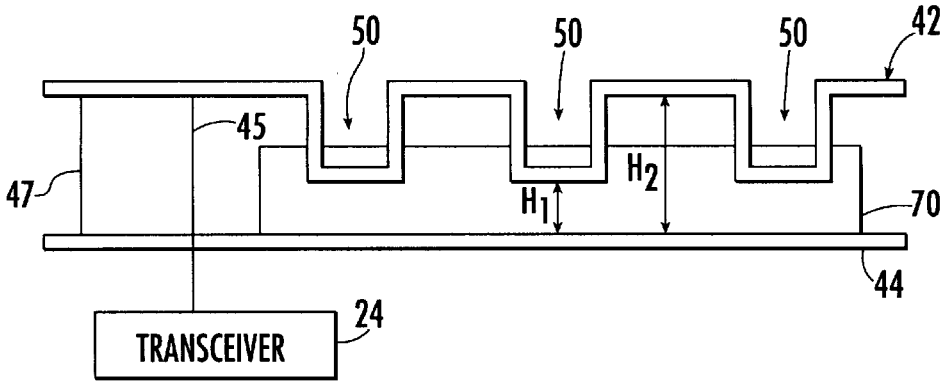
FIG. 5 is a side elevation view of an inverted-F antenna having an elongated, meandering conductive element in spaced-apart, adjacent relationship with a first ground plane and a second ground plane oriented transverse to the first ground plane, according to an embodiment of the present invention.

Referring to FIG. 5, the embodiment of FIG. 4A has been modified to include a second ground plane 70 that is oriented in a direction transverse to the first ground plane 44. The illustrated second ground plane 70 is in adjacent, spaced-apart relationship with the U-shaped undulations 50. Preferably, the second ground plane 70 is spaced apart from the U-shaped undulations 50 by a distance of less than or equal to 10 mm.

In the illustrated embodiment of FIG. 5, the U-shaped undulations 50 are capacitively coupled to the second ground plane 70, as well as to the first ground plane 44. The second ground plane 70 is not limited to the illustrated embodiment. The second ground plane 70 may be configured to be in adjacent, spaced apart relationship with one or more portions of the elongated, meandering conductive element 42. For example, the second ground plane 70 may be in adjacent, spaced apart relationship with a single U-shaped undulation 50. Alternatively, the second ground plane 70 may be in adjacent, spaced apart relationship with selected U-shaped undulations 50. Multiple second ground planes also may be provided.

Figure 6A:
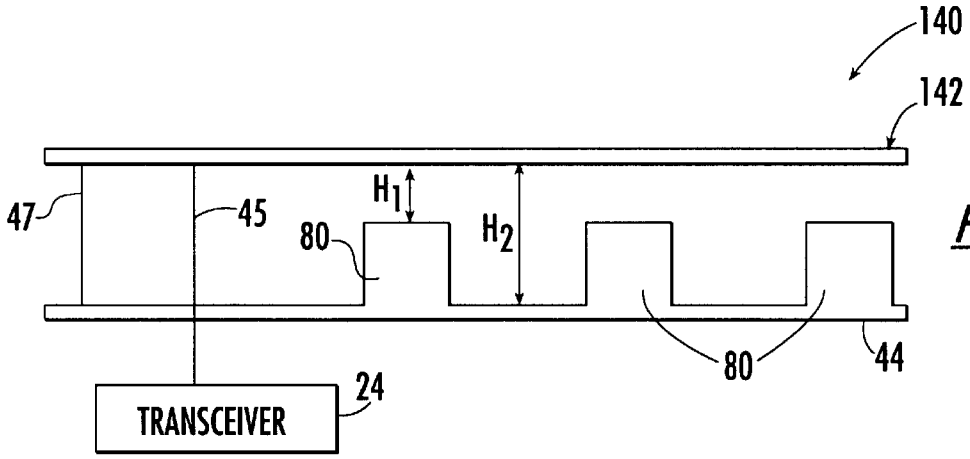
FIG. 6A is a side elevation view of an inverted-F antenna having an elongated conductive element in spaced-apart, adjacent relationship with a ground plane, and wherein the ground plane has a plurality of raised portions extending towards the elongated, conductive element, according to an embodiment of the present invention.
Figure 6B:
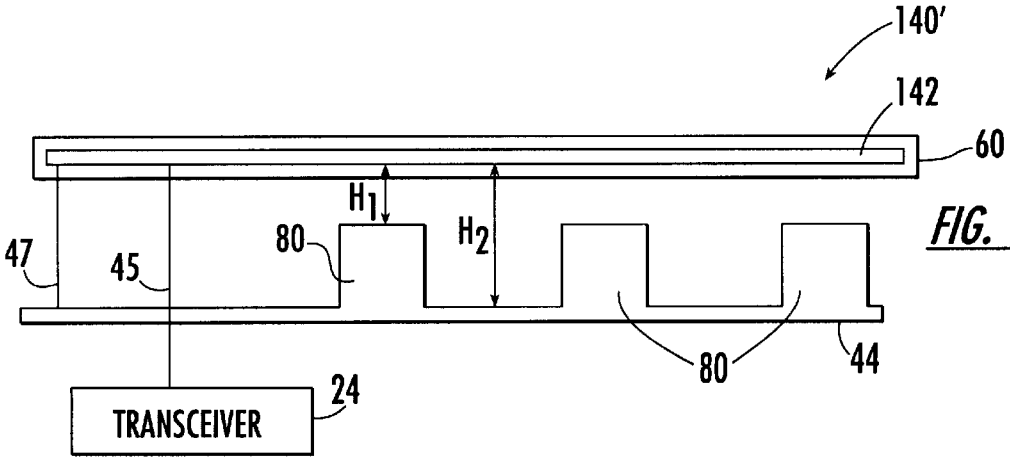
FIG. 6B is a side elevation view of the inverted-F antenna of FIG. 6A disposed within a dielectric material.
Figure 6C:
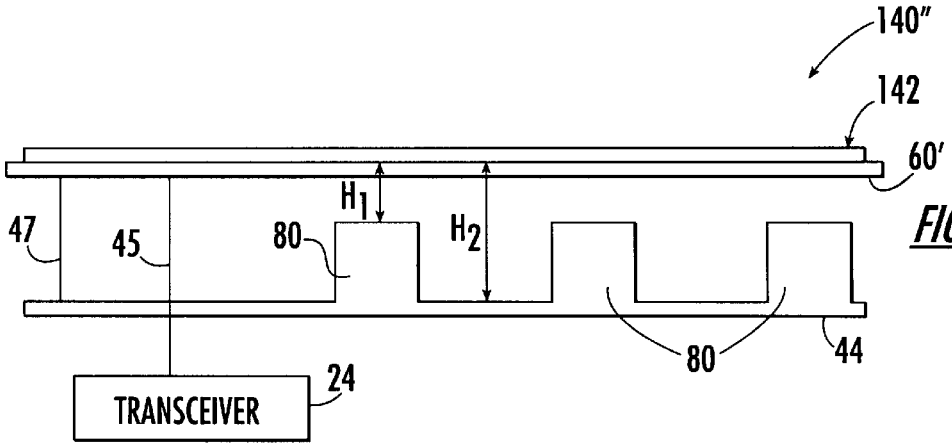
FIG. 6C is a side elevation view of the inverted-F antenna of FIG. 6A disposed on a dielectric material.

Referring now to FIGS. 6A–6C, additional embodiments of the present invention are illustrated. In FIG. 6A, an inverted-F antenna 140 having an elongated conductive element 142, according to an embodiment of the present invention, is illustrated in an installed position within a wireless communications device, such as a radiotelephone. The elongated conductive element 142 is maintained in adjacent, spaced-apart relationship with a ground plane 44. A signal feed 45 electrically connects the conductive element 142 to an RF transceiver 24 within a wireless communications device. A ground feed 47 grounds the conductive element 142 to the ground plane 44.

In the illustrated embodiment, a plurality of raised portions 80 extend outwardly from the ground plane 44. The illustrated grounded portions 80 may be extensions formed within a printed circuit board. The illustrated elongated conductive element 142 is spaced apart from the ground plane by a distance $H_2$, and from each of the raised portions 80 by a distance $H_1$ that is less than the distance $H_2$. The elongated conductive element 142 is capacitively coupled to the raised portions 80 of the ground plane 44.

The distance $H_1$ between the conductive element 142 and the ground plane 44 is preferably maintained at between about 1 mm and about 5 mm. The distance $H_2$ between the conductive element 142 and the raised portions 80 extending from the ground plane 44 is preferably maintained at between about 5 mm and about 15 mm.

A ground plane incorporating raised portions 80 can be thought of as a meandering ground plane. The raised portions 80 can be thought of as spaced-apart undulations. An inverted-F antenna incorporating a meandering ground plane can resonate similarly to an inverted-F antenna having a meandering conductive element. The antenna of FIG. 4A is equivalent to the antenna of FIG. 6A.

Referring now to FIGS. 6B and 6C, alternative embodiments of the antenna of FIG. 6A are illustrated. In FIG. 6B, an inverted-F antenna 140' has an elongated conductive element 142 disposed within dielectric material 60 (e.g., a dielectric substrate). In FIG. 6C, an inverted-F antenna 140" has an elongated conductive element 142 formed on a dielectric material 60' (e.g., a dielectric substrate).

Figure 7A:
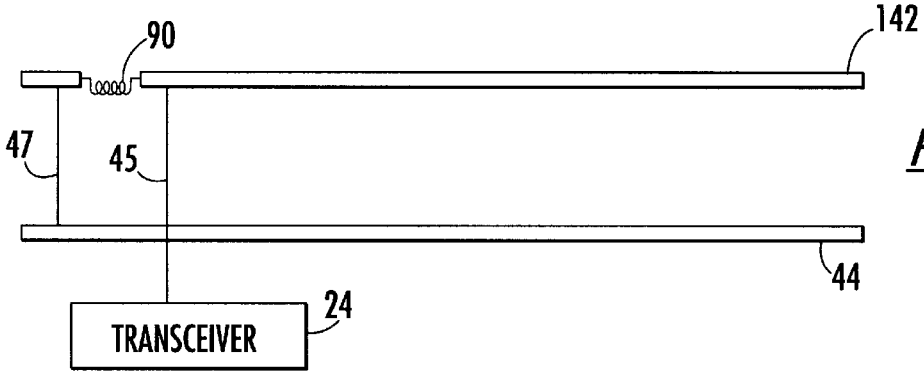
FIGS. 7A and 7B are side elevation views of an inverted-F antenna having an inductive element electrically connected to an elongated conductive element on respective sides of an RF signal feed, according to respective embodiments of the present invention.
Figure 7B:
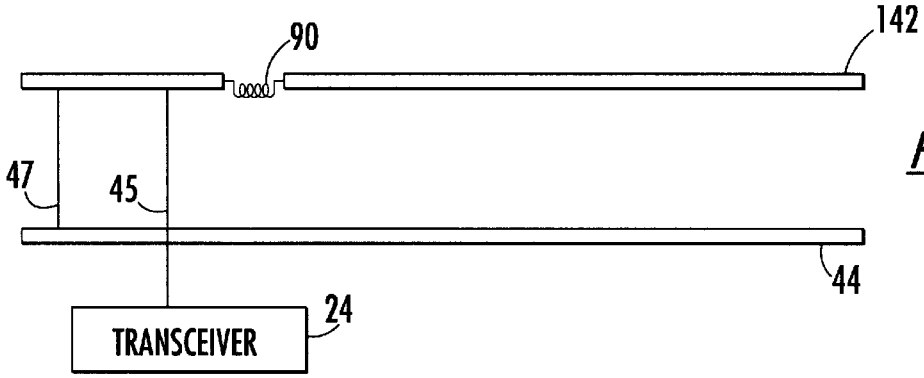

Referring now to FIGS. 7A and 7B, inverted-F antennas according to the present invention may include one or more inductive elements 90. One or more inductive elements 90 may be electrically connected to the elongated conductive element 142 between the RF signal feed 45 and the ground feed 47, as illustrated in FIG. 7A. Alternatively, one or more inductive elements 90 may be electrically connected to the elongated conductive element 142 adjacent the RF signal feed 45 as illustrated in FIG. 7B. An inductive element 90 may comprise helical turns formed in the elongated conductive element 142. Alternatively, various electronic components that can serve an inductive function may be electrically connected to the elongated conductive element 142.

In each of the above-illustrated embodiments, a preferred conductive material out of which an elongated conductive element (42 of FIGS. 4A–4C and FIG. 5; 142 of FIGS. 6A–6C and FIGS. 7A–7B) may be formed is copper. For example, the conductive elements 42, 142 may be formed from copper wire. Alternatively, the conductive elements 42, 142 may be a copper trace disposed on or within a substrate, as illustrated in FIGS. 4B, 4C, 6B, 6C. However, an elongated conductive element according to the present invention may be formed from various conductive materials and is not limited to copper.

The elongated conductive element 42, 142 is typically 0.5 ounce (14 grams) copper. However, conductive elements 42, 142 according to the present invention may have various thicknesses. The width of an elongated conductive element according to the present invention may vary (either widened or narrowed), and need not remain constant.

Antennas according to the present invention may also be used with wireless communications devices which only transmit or receive radio frequency signals. Such devices which only receive signals may include conventional AM/FM radios or any receiver utilizing an antenna. Devices which only transmit signals may include remote data input devices.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An inverted-F antenna, comprising:

a first ground plane;

an elongated conductive element capacitively coupled to the first ground plane, wherein the elongated conductive element is in adjacent, spaced-apart relationship with the first ground plane, wherein a first plurality of segments of the elongated conductive element are spaced apart from the first ground plane by a first distance, and wherein a second plurality of segments of the elongated conductive element are spaced apart from the first ground plane by a second distance greater than the first distance;

an RF signal feed extending from the elongated conductive element; and a ground feed extending from the elongated conductive element adjacent the RF signal feed and electrically grounding the elongated conductive element.

2. The antenna according to claim 1 wherein the first distance is less than or equal to about five millimeters (5 mm), and wherein the second distance is less than or equal to about fifteen millimeters (15 mm).

3. The antenna according to claim 1 wherein the elongated conductive element comprises a meandering section having a plurality of spaced-apart undulations that extend towards the first ground plane.

4. The antenna according to claim 3 wherein the plurality of spaced-apart undulations comprises a plurality of U-shaped portions.

5. The antenna according to claim 4 wherein each U-shaped portion comprises a pair of spaced-apart side segments that extend towards the first ground plane and a base segment substantially orthogonal to the pair of spaced-apart side segments that connects the spaced-apart side segments together, and wherein each base segment is spaced apart from the first ground plane by a distance of less than or equal to about five millimeters (5 mm).

6. The antenna according to claim 1 wherein the ground plane is a meandering ground plane having a plurality of spaced-apart undulations that extend towards the elongated conductive element.

7. The antenna according to claim 1 wherein the elongated conductive element is disposed on dielectric material.

8. The antenna according to claim 1 wherein the elongated conductive element is disposed within dielectric material.

9. The antenna according to claim 1 further comprising a second ground plane oriented in a direction transverse to the first ground plane, wherein the second ground plane is in adjacent, spaced-apart relationship with at least a portion of the elongated conductive element, and wherein the at least one portion of the elongated conductive element is capacitively coupled to the second ground plane.

10. The antenna according to claim 9 wherein the second ground plane is spaced-apart from the at least one portion of the elongated conductive element by a distance of less than or equal to ten millimeters (10 mm).

11. An inverted-F antenna, comprising:

a first ground plane;

an elongated, meandering conductive element capacitively coupled to the first ground plane, wherein the elongated, meandering conductive element is in adjacent, spaced-apart relationship with the first ground plane, wherein the elongated, meandering conductive element comprises a plurality of U-shaped portions that extend towards the first ground plane;

an RF signal feed extending from the elongated, meandering conductive element; and a ground feed extending from the elongated, meandering conductive element adjacent the RF signal feed and electrically grounding the meandering conductive element.

12. The antenna according to claim 11 wherein each U-shaped portion comprises a pair of spaced-apart side segments that extend towards the first ground plane and a base segment that connects the side segments together, and wherein each base segment is spaced apart from the first ground plane by a distance of less than or equal to about five millimeters (5 mm).

13. The antenna according to claim 11 wherein the elongated, meandering conductive element is disposed on dielectric material.

14. The antenna according to claim 11 wherein the elongated, meandering conductive element is disposed within dielectric material.

15. The antenna according to claim 11 further comprising a second ground plane oriented in a direction transverse to the first ground plane, wherein the second ground plane is in adjacent, spaced-apart relationship with at least one U-shaped portion, and wherein the at least one U-shaped portion is capacitively coupled to the second ground plane.

16. An inverted-F antenna, comprising:

a ground plane;

at least one grounded portion extending outwardly from the ground plane;

an elongated conductive element in adjacent, spaced-apart relationship with the ground plane and with the at least one outwardly extending grounded portion, wherein the elongated conductive element is spaced apart from the ground plane by a first distance, and wherein the elongated conductive element is spaced apart from the at least one outwardly extending grounded portion by a second distance less than the first distance;

an RF signal feed extending from the elongated conductive element; and a ground feed extending from the elongated conductive element adjacent the RF signal feed and electrically grounding the elongated conductive element.

17. The antenna according to claim 16 wherein the first distance is less than or equal to about fifteen millimeters (15 mm), and wherein the second distance is less than or equal to about five millimeters (5 mm).

18. The antenna according to claim 16 wherein the at least one outwardly extending grounded portion comprises a plurality of spaced-apart, outwardly extending grounded portions.

19. The antenna according to claim 16 wherein the elongated conductive element is disposed on dielectric material.

20. The antenna according to claim 16 wherein the elongated conductive element is disposed within dielectric material.

21. An inverted-F antenna, comprising:

a ground plane;

an elongated conductive element in adjacent, spaced-apart relationship with the ground plane;

an RF signal feed extending from the elongated conductive element;

a ground feed extending from the elongated conductive element adjacent the RF signal feed and electrically grounding the elongated conductive element; and an inductive element electrically connected to the elongated conductive element adjacent the RF signal feed, wherein the inductive element comprises a plurality of helical turns.

22. The antenna according to claim 21 wherein the inductive element is electrically connected to the elongated conductive element between the RF signal feed and the ground feed.

23. A wireless communicator, comprising:

a housing configured to enclose a transceiver that transmits and receives wireless communications signals; and an inverted-F antenna disposed within the housing, comprising:

a first ground plane;

an elongated conductive element capacitively coupled to the first ground plane, wherein the elongated conductive element is in adjacent, spaced-apart relationship with the first ground plane, wherein a first plurality of segments of the elongated conductive element are spaced apart from the first ground plane by a first distance, and wherein a second plurality of segments of the elongated conductive element are spaced apart from the first ground plane by a second distance greater than the first distance;

an RF signal feed extending from the elongated conductive element; and a ground feed extending from the elongated conductive element adjacent the RF signal feed and electrically grounding the elongated conductive element.

24. The wireless communicator according to claim 23 wherein the first distance is less than or equal to about five millimeters (5 mm), and wherein the second distance is less than or equal to about fifteen millimeters (15 mm).

25. The wireless communicator according to claim 23 wherein the elongated conductive element comprises a meandering section having a plurality of spaced-apart undulations that extend towards the first ground plane.

26. The wireless communicator according to claim 25 wherein the plurality of spaced-apart undulations comprises a plurality of U-shaped portions.

27. The wireless communicator according to claim 26 wherein each U-shaped portion comprises a pair of spaced-apart side segments that extend towards the first ground plane and a base segment substantially orthogonal to the pair of spaced-apart side segments that connects the spaced-apart side segments together, and wherein each base segment is spaced apart from the first ground plane by a distance of less than or equal to about five millimeters (5 mm).

28. The wireless communicator according to claim 23 further comprising a second ground plane oriented in a direction transverse to the first ground plane, wherein the second ground plane is in adjacent, spaced-apart relationship with at least a portion of the elongated conductive element, and wherein the at least one portion of the elongated conductive element is capacitively coupled to the second ground plane.

29. The wireless communicator according to claim 28 wherein the second ground plane is spaced-apart from the at least one portion of the elongated conductive element by a distance of less than or equal to ten millimeters (10 mm).

30. The wireless communicator according to claim 23 wherein the wireless communicator comprises a radiotelephone.

31. A wireless communicator, comprising:

a housing configured to enclose a transceiver that transmits and receives wireless communications signals; and an inverted-F antenna disposed within the housing, comprising:

a first ground plane;

an elongated, meandering conductive element capacitively coupled to the first ground plane, wherein the elongated, meandering conductive element is in adjacent, spaced-apart relationship with the first ground plane, wherein the elongated, meandering conductive element comprises a plurality of U-shaped portions that extend towards the first ground plane;

an RF signal feed extending from the elongated, meandering conductive element; and a ground feed extending from the elongated, meandering conductive element adjacent the RF signal feed and electrically grounding the meandering conductive element.

32. The wireless communicator according to claim 31 wherein each U-shaped portion comprises a pair of spaced-apart side segments that extend towards the first ground plane and a base segment that connects the side segments together, and wherein each base segment is spaced apart from the first ground plane by a distance of less than or equal to about five millimeters (5 mm).

33. The wireless communicator according to claim 31 further comprising a second ground plane oriented in a direction transverse to the first ground plane, wherein the second ground plane is in adjacent, spaced-apart relationship with at least one of the U-shaped portions, and wherein at least one U-shaped portion is capacitively coupled to the second ground plane.

34. The wireless communicator according to claim 31 wherein the wireless communicator comprises a radiotelephone.

35. A wireless communicator, comprising:

a housing configured to enclose a transceiver that transmits and receives wireless communications signals; and an inverted-F antenna disposed within the housing, comprising:

a ground plane;

at least one grounded portion extending outwardly from the ground plane;

an elongated conductive element in adjacent, spaced-apart relationship with the ground plane and with the at least one outwardly extending grounded portion, wherein the elongated conductive element is spaced apart from the ground plane by a first distance, and wherein the elongated conductive element is spaced apart from the at least one outwardly extending grounded portion by a second distance less than the first distance;

an RF signal feed extending from the elongated conductive element; and a ground feed extending from the elongated conductive element adjacent the RF signal feed and electrically grounding the elongated conductive element.

36. The wireless communicator according to claim 35 wherein the first distance is less than or equal to about fifteen millimeters (15 mm), and wherein the second distance is less than or equal to about five millimeters (5 mm).

37. The wireless communicator according to claim 35 wherein the at least one outwardly extending grounded portion comprises a plurality of spaced-apart, outwardly extending grounded portions.

38. The wireless communicator according to claim 35 wherein the wireless communicator comprises a radiotelephone.

39. A wireless communicator, comprising:

a housing configured to enclose a transceiver that transmits and receives wireless communications signals; and an inverted-F antenna disposed within the housing, comprising:

a ground plane;

an elongated conductive element in adjacent, spaced-apart relationship with the ground plane;

an RF signal feed extending from the elongated conductive element;

a ground feed extending from the elongated conductive element adjacent the RF signal feed and electrically grounding the elongated conductive element; and an inductive element electrically connected to the elongated conductive element adjacent the RF signal feed, wherein the inductive element comprises a plurality of helical turns.

40. The wireless communicator according to claim 39 wherein the inductive element is electrically connected to the elongated conductive element between the RF signal feed and the ground feed.

41. The wireless communicator according to claim 39 wherein the wireless communicator comprises a radiotelephone.

* * * * *